US006334243B1

(12) United States Patent
Wolff

(10) Patent No.: US 6,334,243 B1
(45) Date of Patent: Jan. 1, 2002

(54) METHOD OF AND APPARATUS FOR MANIPULATING TOWS OF FILTER MATERIAL FOR TOBACCO SMOKE

(75) Inventor: Stephan Wolff, Glinde (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 09/897,957

(22) Filed: Jul. 5, 2001

(30) Foreign Application Priority Data

Jul. 4, 2000 (DE) ..... 100 31 848

(51) Int. Cl.[7] ..... D02J 1/22
(52) U.S. Cl. ..... 28/246; 28/282
(58) Field of Search ..... 28/247, 282, 283, 28/258, 271, 219, 240, 245, 246; 131/84.1, 88, 77, 78; 493/39, 44

(56) References Cited

U.S. PATENT DOCUMENTS 3,974,007 A 8/1976 Greve
4,259,769 A * 4/1981 Greve et al. ..... 28/283
4,412,505 A 11/1983 Hausler et al.
4,522,616 A * 6/1985 Hyde et al. ..... 28/283
5,135,008 A 8/1992 Oesterling et al.
5,590,449 A 1/1997 Chehab et al.
6,263,882 B1 * 7/2001 Chehab et al. ..... 28/283

FOREIGN PATENT DOCUMENTS

DE 198 11 014 9/1999

* cited by examiner

*Primary Examiner*—Danny Worrell
(74) *Attorney, Agent, or Firm*—Venable; Robert Kinberg

(57) ABSTRACT

A tow of filamentary filter material for tobacco smoke is stretched between an upstream pair and a downstream pair of advancing rolls. Suction nozzles are provided to evacuate air from those portions of the path for the tow which are located immediately upstream and immediately downstream of the path section at the nip of the downstream advancing rolls. This prevents eddying of air at the nip and a fluttering of filaments of the tow.

20 Claims, 2 Drawing Sheets

METHOD OF AND APPARATUS FOR MANIPULATING TOWS OF FILTER MATERIAL FOR TOBACCO SMOKE

CROSS-REFERENCE TO RELATED CASES

The present application claims the priority of the commonly owned copending German patent application Serial No. 100 31 848.7 filed Jul. 4, 2000. The disclosure of the above-referenced German patent application, as well as that of each U.S. and foreign patent and patent application identified in the specification of the present application, is incorporated herein by reference.

BACKGROUND OF THE INVENTION

The present invention relates to improvements in methods of and in apparatus for manipulating (processing) so-called tows or analogous accumulations of acetate fibers or other suitable filamentary filter material for tobacco smoke. More particularly, the invention relates to improvements in methods of and in apparatus for treating tows of filamentary filter material for tobacco smoke on their way from one or more sources (such as bales of compacted tow) to the wrapping mechanism of a filter rod making machine wherein successive increments of the duly processed tow are draped into successive increments of a running web or strip of cigarette paper or other suitable wrapping material for a continuous rod-like filler of filter material.

As a rule, and as disclosed, for example, in U.S. Pat. No. 3,974,007 (granted Aug, 10, 1976 to Greve for "METHOD AND APPARATUS FOR THE PRODUCTION OF FILTER ROD SECTIONS OR THE LIKE") and U.S. Pat. No. 4,412,505 (granted Nov. 1, 1983 to Häusler et al. for "APPARATUS FOR APPLYING ATOMIZED LIQUID TO A RUNNING LAYER OF FILAMENTARY MATERIAL OR THE LIKE"), a tow of acetate fibers is drawn from a bale and advances along an elongated path first through an expanding or stretching unit wherein the originally crimped and interlaced filaments undergo a straightening or lengthening or stretching action between a pair of relatively slow rotary trailing or rear rolls and a pair of relatively rapidly driven front rolls. The thus stretched filaments are advanced through an applicator which sprays a suitable finely atomized plasticizer (such as triacetin) onto and thus causes localized melting of the material of which the filaments are made. The thus treated tow is converted into a rod-like filler wherein softened portions of neighboring filaments adhere to each other to establish a maze of discrete paths for the flow of tobacco smoke between the lighted end of a filter cigarette, cigar or cigarillo and the mouth of the smoker. Conversion of the flattened tow of stretched filaments into a rod-like filler is effected, at least in part, by a so-called gathering horn which precedes the wrapping station. Reference may also be had to published German patent application Serial No. 198 11 014.

U.S. Pat. No. 5,590,449 (granted Jan. 7, 1997 to Chehab et al. for "APPARATUS FOR STRETCHING, PLASTICIZING AND GATHERING A TOW OF FILTER MATERIAL FOR TOBACCO SMOKE") further discloses a so-called gathering unit which is installed between the plasticizer applicator and the aforementioned gathering horn upstream of the wrapping station.

A drawback of presently known filter rod making apparatus is that they are likely to contaminate the surrounding area with fragments of filamentary filter material for tobacco smoke. Moreover, the filaments of the running tow are likely to carry out undesirable stray movements which can affect the distribution of such filaments in the rod-like filler.

OBJECTS OF THE INVENTION

An object of this invention is to provide a novel and improved method of treating the filaments of a running tow of filamentary filter material for tobacco smoke with a view to expel from the tow and to preferably gather any such fragments of filter material which are not desirable in the tubular envelope of the mouthpiece of a filter cigarette, cigar or cigarillo.

Another object of the invention is to provide a novel and improved method of preventing turbulent air from influencing a filter tow successive increments of which advance toward the wrapping station in a filter rod making machine.

A further object of the invention is to provide a novel and improved filter rod making machine, An additional object of the invention is to provide a novel and improved turbulence preventing or reducing arrangement which counteracts undesirable stray movements (such as fluttering) of filaments in a running tow of filamentary filter material for tobacco smoke.

Still another object of the invention is to provide a novel and improved combination of tow advancing and filament constraining means for use in a filter rod making machine.

A further object of the present invention is to provide a novel and improved filter cigarette, cigar, cigarilo or an analogous smokers' product wherein tobacco smoke must pass through a mouthpiece containing filter material for tobacco smoke.

Another object of the invention is to provide a novel and improved method of relieving a flow or tow of filamentary filter matrial for tobacco smoke of short filaments which have been partly separated from and/or which are still embedded in the satisfactory part of the tow.

Still another object of the invention is to prevent or at least reduce the likelihood of contamination of air in the region of a filter rod making machine by particles of filter material for tobacco smoke, A further object of this invention is to provide a smokers' product which can be mass produced in a novel and improved filter rod making machine in such a way that the surrounding atmosphere is not contaminated with fragments of fibrous filter material for tobacco smoke.

SUMMARY OF THE INVENTION

One feature of the present invention resides in the provision of a method of manipulating a running tow of filamentary filter material for tobacco smoke. This method comprises the steps of advancing the tow lengthwise in a predetermined direction (e.g., downwardly) along an elongated path including conveying the tow through the nip of at least one set of advancing members (e.g., two driven rolls), and withdrawing air from a region of the path at the nip.

The withdrawing step can include evacuating air from the path directly at the nip of the advancing members. The path for the tow includes a first portion immediately upstream and a second portion immediately downstream of the nip; the withdrawing step can include evacuating air from the just mentioned portions of the path.

Another feature of the present invention resides in the provision of a method of manipulating a running tow of filamentary filter material for tobacco smoke. The method comprises the step of advancing the tow lengthwise in a predetermined direction along an elongated path, and this advancing step includes conveying the tow through the nip of a first set of advancing members (e.g., a pair of driven rolls) adjacent a first portion of the path and thereafter through the nip of a second set of advancing members (e.g., a pair of driven rolls) adjacent a second portion of the path downstream of the first portion as seen in the predetermined direction. The method further comprises the step of withdrawing air from the region of the nip of at least one of the first and second sets of advancing members.

The at least one set is or can be the second set of advancing members.

The withdrawing step can further include withdrawing air solely from the region of the nip of the second set of advancing members.

A further feature of the present invention resides in the provision of an apparatus for manipulating a running tow of filamentary filter material for tobacco smoke. The improved apparatus comprises means for advancing the tow lengthwise in a predetermined direction along a predetermined path including at least one set of advancing members defining a nip for the running tow at a predetermined section of the path, and means for withdrawing air from the region of the nip.

The advancing members can constitute pairs of driven rolls and the withdrawing means can include means for withdrawing air from at least one portion of the path immediately adjacent the nip.

For example, the withdrawing means can include a substantially funnel shaped air withdrawing member (e.g., a nozzle) having an air intake at the nip and a configuration which is at least substantially complementary to that of the advancing means at the nip.

The aforementioned section of the path for the tow includes a first portion immediately upstream and a second portion immediately downstream of the nip. The withdrawing means can include means for evacuating air from the first and second portions of the section of the path.

The advancing means can further include a second set of advancing members (such as two driven rolls) which are spaced apart from the at least one set of advancing members. The at least one set of advancing members is or can be disposed downstream of the second set of advancing members (as seen in the predetermined direction of forward movement of the tow). Such apparatus can further include a channel which at least partially surrounds the path between the two sets of advancing members and has a discharge end at the at least one set of advancing members.

The channel can at least partially confine a tow gathering unit and/or a tow stretching unit of the improved apparatus.

One set of the advancing members can be installed at a level above the other set of advancing members.

It has been found that the improved apparatus can be utilized with advantage in connection with the processing of tows which consist of or contain acetate fibers.

The novel features which are considered as characteristic of the invention are set forth in particular in the appended claims. The improved apparatus itself, however, both as to its construction and the modes of assembling, installing and operating the same, together with numerous additional important and advantageous features and attributes thereof, wil be best understood upon perusal of the following detailed description of certain presently preferred specific embodiments with reference to the accompanying drawings.

DESCRIPTION OF PREFERRED EMBODIMENTS

Figure 1:
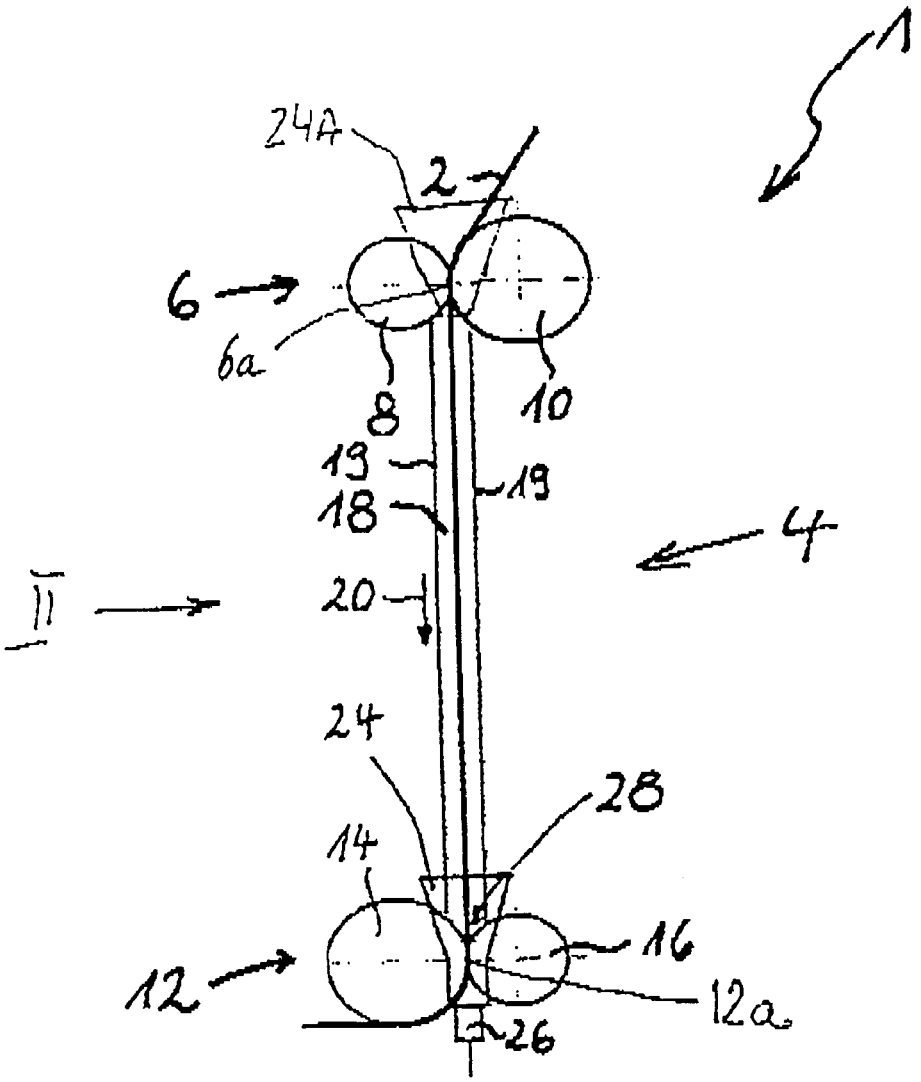
FIG. 1 is a fragmentay elevational view of a filter rod making machine including an apparatus which embodies one presently preferred form of the instant invention.

FIG. 1 shows a portion of a filter rod making machine which constitutes an improvement over and a further development of the machine disclosed and illustrated in FIG. 1 of the aforementioned U.S. Pat. No. 5,590,449 to Chehab et al. and in the aforementioned published German patent application No. 198 11 014. That portion (hereinafter called apparatus) 1 of the filter rod making machine which embodies the present invention includes a unit 4 which serves to stretch (elongate) successive increments of a running tow 2 of filamentary filter material, e.g., acetate fibers. The source of such tow is normally a bale of compacted tow (see the bale 2 in FIG. 1 of the U.S. Pat. No. 5,590,449 to Chehab et al.).

The means for advancing the tow 2 lengthwise in a predetermined direction (indicated in FIG. 1 by the arrow 20) and along an elongated path leading to a so-called gathering horn (shown at 72 in FIG. 1 of the patent to Chehab et al.) includes several sets of tow advancing members each of which can constitute a driven roll. FIG. 1 shows a first (upstream) set or group 6 of cooperating driven rolls 8, 10 which define a nip 6*a* for the passage of successive increments of the tow 2, and a second (downstream) set or group 12 of cooperating driven rolls 14, 16 defining a nip 12*a* for successive increments of the running tow. The two sets of driven rolls form part of the tow stretching unit 4 wherein the normally crimped filaments of the tow 2 are stretched because the peripheral speeds of the rolls 14, 16 exceed those of the rolls 8, 10. The stretching or tensioning action can be selected in such a way that the filaments advancing through the nip 12*a* are straight and at least substantially parallel to each other. The manner in which the rolls of the sets or groups 6 and 12 are or can be driven and their speeds (i.e., their stretching action upon the tow) adjusted is fully disclosed, for example, in the aforementioned U.S. Pat. No. 4,412,505 to Häusler et al. The relationship between the peripheral speeds of the upstream rolls 8, 10 on the one hand, and the peripheral speeds of the rolls 14, 16 on the other hand, can be such that the at least slightly elastic filaments of the tow are not only straightened but also stretched between the nips 6*a* and 12*a* of the sets or groups 6, 12.

Those increments of the filaments constituting the tow 2 which advance beyond the nip 12*a* of the rolls 14, 16 are permitted to relax, i.e., they are subjected to considerably less pronounced tensional stresses in a manner as fully described in the aforementioned U.S. Pat. No. 5,590,449 to Chehab et al. The illustrated tow stretching unit 4 is followed by an applicator which sprays minute droplets of a suitable atomized plasticizer (such as triacetin) upon portions of discrete filaments of the tow 2. The droplets of plasticizer cause localized melting of the filaments and ensure that such portions of filaments adhere to portions of neighboring filaments so that the tow can establish the aforementioned maze of paths for the flow of tobacco smoke from the lighted end of a filter cigarette, through the filter mouthpiece which contains a length of a properly treated tow, and into the mouth of the smoker.

The next step involves a change of the cross-sectional area of the stretched, sprayed on and relaxed tow 2 in a so-called gathering unit, e.g., a unit disclosed in the U.S. patent to Chehab et al. This entails a reduction of the width of the tow 2 so that it can assume a circular cross-sectional outline not later than after it issues from the gathering horn on its way into the wrapping mechanism of the filter rod making machine.

The tow 2 is flat or substantially flat in that portion of its path which extends between the pairs of rolls 8, 10 and 14, 16. This portion of the path for the running tow 2 is at least partially but preferably fully surrounded by the walls 19 of an elongated channel or duct 18. The outlet 28 of this channel is close to the nip 12*a* of the donstream pair or set 12 of rolls 14, 16. This nip is flanked by two closely adjacent suction nozzles 24, 26 which are respectively adjacent the path section immediately upstream and the path section immediately downstream of the nip 12*a*. These nozzles form part of a unit which serves to withdraw air from the region of the nip 12*a*, preferably from the region immediately adjacent the upstream and downstream sides of this nip. At least one (24) of the nozzles 24, 26 is or can resemble a funnel and its walls are or can be configurated in such a way that they closely follow the surfaces of the adjacent portions of the rolls 14 and 16.

Figure 2:
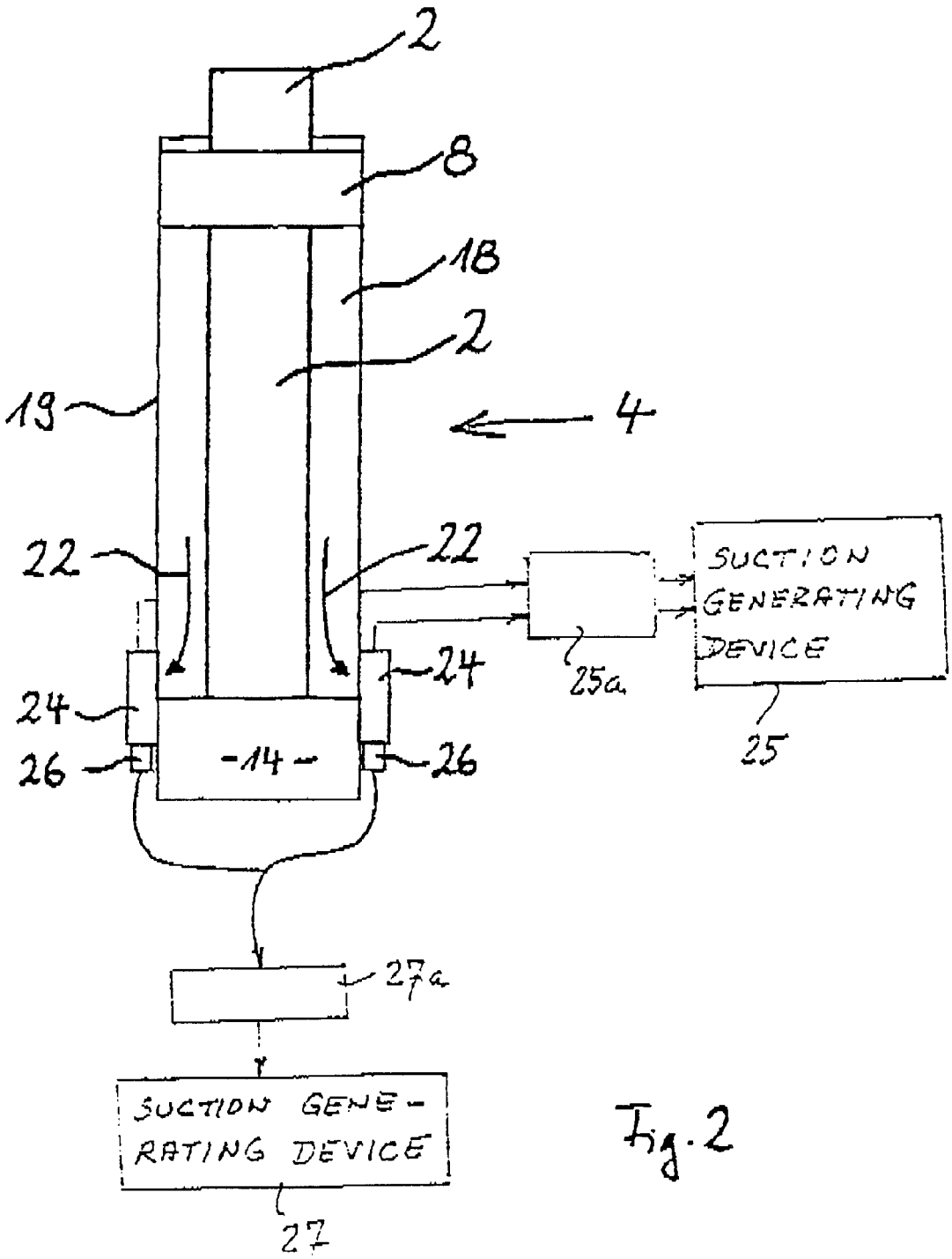
FIG. 2 is a view as seen in the direction of arrow II from the left-hand side of FIG. 1.

Reference may also be had to FIG. 2 wherein the streams of air being drawn into the nozzle 24 are indicated by arrows 22. The outlets of this nozzle are connected to the suction intake of a blower or another suitable suction generating device 25. A second suction generating device 27 draws air from the outlet(s) of the nozzle 26. A first air flow sifting device 25*a* (e.g., a filter) is provided to gather impurities (such as fragments of filamentary filter material and/or matter other than filter material) in the conduit or conduits leading from the nozzle or nozzles 24 to the auction intake(s) of the device 25. A second flow sifting device 27*a* is provided to intercept unacceptable fragments of filamentary filter material and/or other impurities or foreign matter in the conduit(s) connecting the outlet(s) of the nozzle(s) 26 with the intake(s) of the device 27.

It often suffices to withdraw air only from the region of the nip 12*a* of the downstream rolls 14, 16. However, it is equally possible to provide air withdrawing means only in the region of the nip 6*a* or in the region of the nips 6*a* and 12*a*. This is shown in FIG. 1 wherein the character 24A denotes a suction nozzle at the upstream side of the nip 6a of the rolls 8 and 10. The nozzle 24A can be configurated, dimensioned and installed in such a way that it can draw air from the path portions immediately upstream as well as immediately downstream of the nip 6*a*.

FIG. 2 shows that the nozzle 24 includes two portions (e.g., two halves which are or which can be mirror images of each other) disposed at the two axial ends (i.e., at the end faces) of the rolls 14 and 16 to draw air transversely of the direction of advancement of the tow 2. The same can apply for nozzle 26 and/or 24A (the latter not shown in FIG. 2), i.e., air can be evacuated transversely of the direction of advancement of tow and toward the end faces of rolls at the respective nip. Air which is being drawn from the downstream and/or upstream sides of the nip 12*a* is mainly that air which enters the channel 18 at the nip 6*a* and flows in the channel 18 toward the rolls 14, 16 to leave the channel at the nip 12*a*.

In accordance with a modification, the channel 18 (or an equivalent or extension thereof) can confine one or more units of the apparatus 1 or an equivalent apparatus. For example, this channel (or a downstream extension thereof) can be utilized to confine a portion of or the entire tow gathering unit and/or the tow stretching unit or at least one of several stretching units.

An important advantage of the improved apparatus 1 (or of the aforedescribed and many other equivalents and modifications thereof) is that the means for withdrawing air from the region(s) of at least one of the nips 6*a*, 12*a* greatly reduces the likelihood of development of air turbulence (such as eddy currents) and the resulting fluttering and/or other undesirable stray movements of the filaments at the nip 6*a* and/or 12*a*. The provision of air withdrawing means (24, 25, 25*a*, 26, 27, 27*a*) at the downstream nip 12*a* is especially desirable and advantageous because it has been ascertained that a large percentage of fragments of filaments of filter material for tobacco smoke develops in the channel 18, i.e., downstream of the nip 6*a*.

Gathering of segregated fragments and impurities (if any) at 25*a* and/or 27*a* is desirable and advantageous because such undertaking reduces the likelihood of rapid clogging of the suction generating devices 25, 27 and/or contamination of air around the apparatus. Furthermore, and as already mentioned hereinbefore, an additional important advantage of the improved method and apparatus is that the particles which are intercepted at 25*a* and 27*a* (and the particles which are withdrawn by the nozzle or nozzles 24*a*) cannot enter the filter rod making machine proper, i.e., they cannot be confined in the tubular envelopes of filter mouthpieces. The manner in which filter rod sections (filter mouthpieces) of unit length or multiple unit length are or can be combined with plain cigarettes, cigars or cigarillos to form therewith filter cigarettes, cigars or cigarillos of unit length or multiple unit length is disclosed, for example, in commonly owned U.S. Pat. No. 5,135,008 granted Aug. 4, 1992 to Oesterling et al. for "METHOD OF AND APPARATUS FOR MAKING FILTER CIGARETTES".

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of preventing air-induced fluttering of filamentary filter material for tobacco smoke in a filter rod making machine and, therefore, such adaptations should and are intended to be comprehended within the meaning and range of equivalence of the appended claims.

What is claimed is:

1. A method of manipulating a running tow of filamentary filter material for tobacco smoke, comprising the steps of:

advancing the tow lengthwise in a predetermined direction along an elongated path, including conveying the tow through a nip of at least one set of advancing members; and withdrawing air from a region at the nip.

2. The method of claim 1, wherein the advancing members are rolls having end faces.

3. The method of claim 2, wherein said withdrawing step includes evacuating air from said path transversely of said direction directly at the end faces of the rolls.

4. The method of claim 3, wherein the path includes a first portion immediately upstream and a second portion immediately downstream of the nip, said withdrawing step including evacuating air from said portions of said path.

5. A method of manipulating a running tow of filamentary filter material for tobacco smoke, comprising the steps of:

advancing the tow lengthwise in a predetermined direction along an elongated path, including conveying the tow through the nip of a first set of advancing members adjacent a first portion of the path and thereafter through the nip of a second set of advancing members adjacent a second portion of the path downstream of the first portion as seen in said predetermined direction; and withdrawing air from the region of the nip of at least one of the first and second sets of advancing members.

6. The method of claim 5, wherein the advancing members are rolls.

7. The method of claim 5, wherein said at least one set is the second set of advancing members.

8. The method of claim 5, wherein said withdrawing step further includes withdrawing air solely from the region of the nip of said second set of advancing members.

9. Apparatus for manipulating a running tow of filamentary filter material for tobacco smoke, comprising:

means for advancing the tow lengthwise in a predetermined direction along a predetermined path, including at least one set of advancing members defining a nip for the running tow at a predetermined section of said path; and means for withdrawing air from the region of said nip.

10. The apparatus of claim 9, wherein said advancing members are rolls having end faces.

11. The apparatus of claim 10, wherein said withdrawing means includes means for withdrawing air from from at least one portion of said path immediately adjacent said nip, at the end faces of said rolls and transversely of said predetermined direction.

12. The apparatus of claim 9, wherein said withdrawing means includes a substantially funnel-shaped air withdrawing member having an air intake at said nip and a configuration at least substantially complementary to that of said advancing means at said nip.

13. The apparatus of claim 9, wherein said section of said path includes a first portion immediately upstream and a second portion immediately downstream of said nip, said witdrawing means including means for evacuating air from said first and second portions of said section of said path.

14. The apparatus of claim 9, wherein said advancing means further includes a second set of advancing members spaced apart from said at least one set of advancing members.

15. The apparatus of claim 14, wherein said at least one set of advancing members is disposed downstream of said second set of advancing members as seen in said predetermined direction.

16. The apparatus of claim 14, further comprising a channel at least partially surrounding said path between said sets of advancing members and having a discharge end at said at least one set of advancing members.

17. The apparatus of claim 16, further comprising a tow gathering unit at least partially confined in said channel.

18. The apparatus of claim 16, further comprising a tow stretching unit at least partially confined in said channel.

19. The apparatus of claim 14, wherein one of said sets of advancing members is disposed at a level above the other set.

20. The apparatus of claim 9, wherein the tow contains acetate fibers.

* * * * *